US007407048B2

(12) United States Patent
Boom

(10) Patent No.: US 7,407,048 B2
(45) Date of Patent: Aug. 5, 2008

(54) SAFETY SWITCH AND METHOD OF CHECKED REDUNDANCY

(75) Inventor: Anthony S. Boom, Moline, IL (US)

(73) Assignee: Kone Corporation, Helsinki (FI)

( * ) Notice: Subject to any disclaimer, the term of this patent is extended or adjusted under 35 U.S.C. 154(b) by 165 days.

(21) Appl. No.: 11/506,925

(22) Filed: Aug. 21, 2006

(65) Prior Publication Data

US 2008/0041692 A1 Feb. 21, 2008

(51) Int. Cl.
*B66B 29/00* (2006.01)

(52) U.S. Cl. ..... 198/323

(58) Field of Classification Search ..... 198/323
See application file for complete search history.

(56) References Cited

U.S. PATENT DOCUMENTS 5,186,300 A * 2/1993 Zaharia ..... 198/322
5,526,256 A * 6/1996 Sakata et al. ..... 700/79
5,601,178 A 2/1997 Zaharia et al.
5,708,416 A * 1/1998 Zaharia et al. ..... 340/531
5,992,604 A * 11/1999 Buescher et al. ..... 198/322
6,230,871 B1 5/2001 Balzer-Apke et al.
6,758,319 B1 7/2004 Lange et al.
6,827,196 B2 * 12/2004 Wiesinger et al. ..... 198/323

* cited by examiner

*Primary Examiner*—Mark A Deuble
(74) *Attorney, Agent, or Firm*—Venable LLP; Jeffri A. Kaminski

(57) ABSTRACT

An apparatus and method of disabling a drive system of a passenger conveying system is provided. The passenger conveying system is monitored with switches each arranged to detect a respective malfunction of the passenger conveying system. A shutdown signal is produced by a respective one of the switches detecting the respective malfunction and is coupled to a corresponding shutdown contact and to a controller. The corresponding shutdown contact operates to interrupt a drive enabling signal of the drive system in response to receipt of the shutdown signal. The controller monitors the shutdown signals from the switches and the drive enabling signal. The controller sends a signal to open a redundant contact to interrupt the drive enabling signal if the shutdown signal is detected and the drive system remains enabled.

21 Claims, 2 Drawing Sheets

SAFETY SWITCH AND METHOD OF CHECKED REDUNDANCY

BACKGROUND OF THE INVENTION

Escalators are provided with safety systems, each one of which is operable to stop movement of the escalator in the event that an unsafe operating condition is detected. Examples of such unsafe operating conditions include: a missing step or a detached step on the escalator; a handrail which is moving at an improper speed; something becoming caught between adjacent steps or between the steps and the side skirts; a foreign object becoming lodged between the step treads and the comb plate at the escalator exit landing; or the like. The safety system components used to detect unsafe escalator operating conditions include proximity sensors, switches, pressure sensors, or the like, which are able to detect unsafe escalator-operating conditions so long as the sensors and their associated circuitry remain operative.

U.S. Pat. No. 5,601,178 describes a method and apparatus for checking escalator safety circuit components to confirm circuit operability prior to start up of motion of the escalator. A start up check relay is energized whenever escalator motor motive power is interrupted. The start up check relay checks speed and non-speed-dependent safety circuit components to determine whether these safety circuit components have all come to an escalator start up state. When the start up condition of these safety circuit components has been verified the circuit allows power to be applied to the escalator motor. When power is applied to the escalator motor, a start up delay timer is energized and the start up check relay is de-energized. When speed-dependent components of the escalator have come to operating speeds, the start up delay timer will be de-energized, and the escalator will continue movement in its normal operating mode provided that all safety circuits are fully operational.

U.S. Pat. No. 6,230,871 describes a device for monitoring functional units on escalators and moving walkways, comprising several processors which monitor predetermined parameters of a particular functional unit independently of each other. The processors are connected to devices for immediately shutting down the escalator or moving walkway and interact with at least one other processor which is provided for controlling and/or diagnosing functions which are not relevant to safety.

U.S. Pat. No. 6,758,319 describes a method and a system for disconnecting passenger transport systems, especially escalators and moving walkways. Functional units of a passenger transport system monitor for malfunctions of the passenger transport systems by using switching elements and the signals of the functional units are combined to form a security chain. The signals of the functional units and signals from a drive monitoring unit are supplied to at least one pilot unit. Subsequently, a disconnecting signal is provided to a respective disconnecting contact as a result of a malfunction detected by the functional units and/or the drive monitoring system.

Current safety systems require large amounts of wiring and switches. Also, there is no mechanism provided for determining the operability of the safety system detectors or their circuitry. There is a need for a cost effective solution that addresses these problems.

SUMMARY OF THE INVENTION

In an exemplary embodiment of the invention, a safety circuit for a passenger conveyor having a drive system is provided. The safety circuit comprises a plurality of controllable switches, each switch of the first plurality of controllable switches being responsive to a functional unit associated with the passenger conveyor to produce a first switch output signal having a first state if the functional unit is operating properly and a second state if the functional unit is malfunctioning; a controller apparatus including: a plurality of input terminals each coupled to a respective one of the switches for receiving the respective switch output signals; a plurality of interrupt switches, each interrupt switch being arranged in electrical series to conduct a drive enabling signal for the drive system when all of the interrupt switches are in a closed state, each interrupt switch being coupled to a respective one of the input terminals and being opened in response to a respective first switch output signal having the second state to interrupt the drive enabling signal to stop operation of the drive system; a redundant interrupt switch arranged in electrical series with the plurality of interrupt switches, wherein the series connection of the redundant interrupt switch and the plurality of interrupt switches has an output producing a second output signal having a first state if all of the interrupt switches and the redundant interrupt switch are closed and a second a state if any one of the interrupt switches and the redundant interrupt switch is open; and a controller arranged to monitor the state of the first switch output signals of the plurality of controllable switches and to monitor the state of the second output signal, the controller sending a signal to open the redundant interrupt switch when the signal state of the any one of the first switch output signals has the second output state and the second output signal has the first signal state.

In another embodiment of the invention, a method of disabling a drive system of a passenger conveying system is provided. The method comprises monitoring the passenger conveying system with switches each arranged to detect a malfunction of the passenger conveying system; providing a shutdown signal from a respective one of the switches detecting a malfunction to a corresponding shutdown contact and to a controller; operating the corresponding shutdown contact to interrupt a drive enabling signal of the drive system in response to receipt of the shutdown signal from one of the switches; monitoring the shutdown signals from the switches and the drive enabling signal with the controller; sending a signal from the controller to open a redundant contact to interrupt the drive enabling signal if the shutdown signal is detected and the drive system remains enabled.

In another embodiment of the invention, a method comprises monitoring a passenger conveying system with functional units, each functional unit having a switch; providing a shutdown signal from a respective switch for the functional unit to a controller and to a corresponding shutdown contact when a fault with the passenger conveying system is detected by the functional unit; detecting with the controller if the shutdown contact opens; sending a signal from the controller to open a redundant contact if the shutdown contact does not open.

DETAILED DESCRIPTION OF PREFERRED EMBODIMENTS

Figure 1:
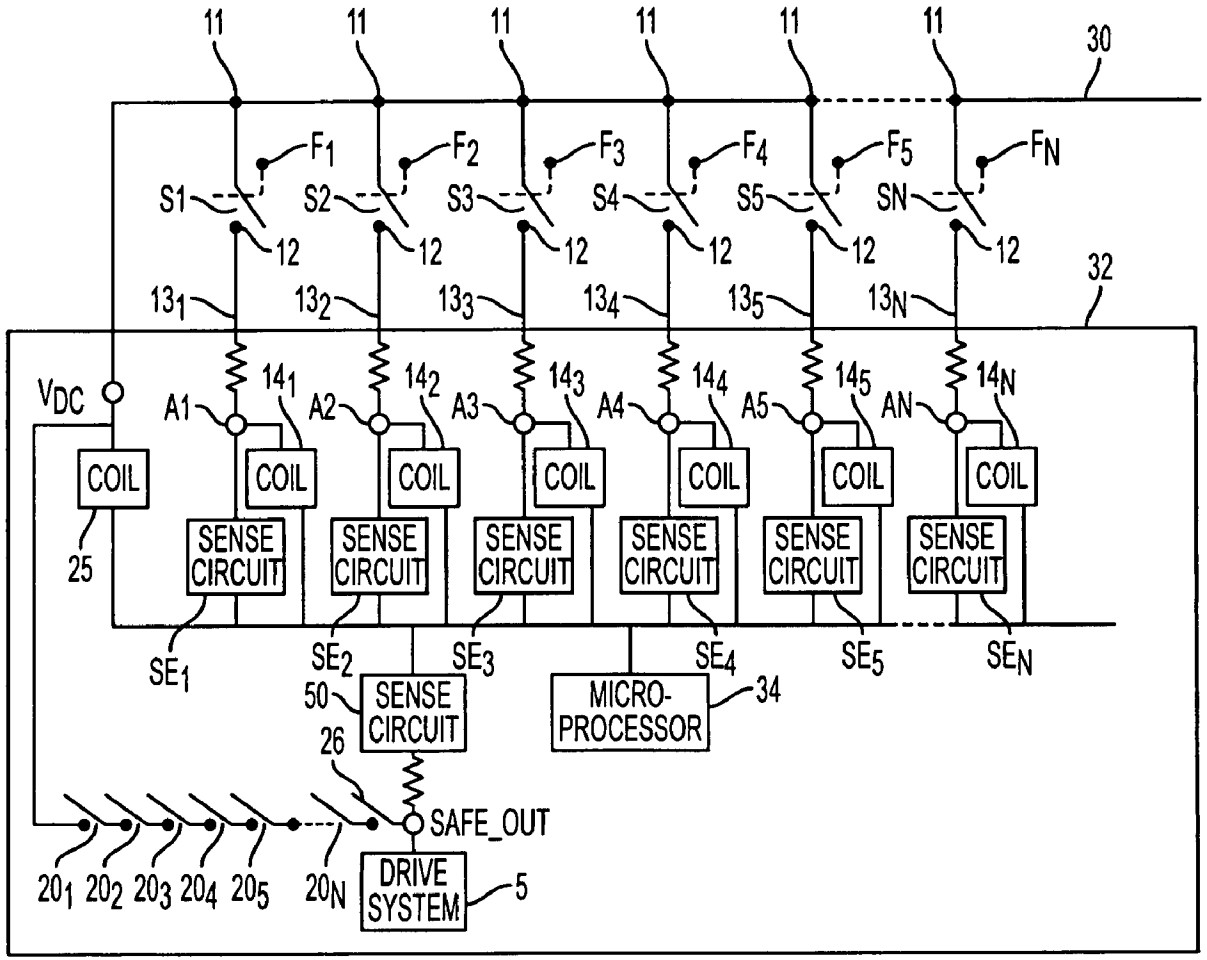
FIG. 1 is a block diagram of a circuit according to an embodiment of the invention.

FIG. 1 illustrates an exemplary embodiment of a safety circuit according to the invention. The safety circuit may be used for stopping operation of passenger conveying systems, such as escalators, moving walkways, travelators, etc. The safety circuit includes a number of switches S1-SN that are associated with and controlled by respective functional units $F_1$-$F_N$, for example handrail intake monitoring, step intake monitoring, chain brake monitoring, etc. Switches S1-SN are normally closed during operation, although for purposes of illustration they are all shown in the open state. The switches S1-SN may be activated when a fault in a corresponding functional unit of the passenger conveying system is detected. The switches S1-SN may be connected in parallel with each other. One contact 11 of each respective switch S1-SN is connected to a signal line 30. A voltage may be applied to the signal line 30. The other contact 12 of each switch S1-SN is connected to a respective input A1-AN on a controller board 32.

The controller board 32 may be arranged at a distance from the switches S1-SN, sometimes hundreds of feet. In embodiments of the invention, an individual wire $\mathbf{13}_1$-$\mathbf{13}_N$ from a respective switch S1-SN to the controller board 32 may couple the switches S1-SN to the controller board 32. This structure and accompanying method may eliminate the need for two or more wires from the switches to the controller board 32, for example, as shown in U.S. Pat. No. 6,758,319, and provide a significant savings in material and labor.

A plurality of interrupt switches may be coupled, respectively, to inputs A1-AN on the controller board 32. The inputs A1-AN may be coupled to corresponding switches S1-SN to receive switch output signals. The interrupt switches may be arranged in electrical series to conduct a drive enable signal for the drive system 5 of the passenger conveying system. The interrupt switches may comprise electrical switches, electro-mechanical switches, and/or mechanical switches.

For example, the interrupt switches may comprise relays including coils $\mathbf{14}_1$-$\mathbf{14}_N$ and corresponding contacts $\mathbf{20}_1$-$\mathbf{20}_N$. The contacts $\mathbf{20}_1$-$\mathbf{20}_N$ are closed during operation of the drive system 5. The coils $\mathbf{14}_1$-$\mathbf{14}_N$ may be coupled, respectively, to inputs A1-AN on the controller board 32. The contacts $\mathbf{20}_1$-$\mathbf{20}_N$ may be arranged in electrical series. The series connection of contacts $\mathbf{20}_1$-$\mathbf{20}_N$ conducts the drive enable signal for the drive system 5 of the passenger conveying system.

When a switch S1-SN is opened, a signal is sent to open corresponding interrupt switch to interrupt the drive enable signal and stop operation of the passenger conveying system. For example, opening one of switches S1-SN interrupts current flow through the corresponding coil $\mathbf{14}_1$-$\mathbf{14}_N$, causing the corresponding contacts $\mathbf{20}_1$-$\mathbf{20}_N$ to open. Opening any one of contacts $\mathbf{20}_1$-$\mathbf{20}_N$ interrupts the drive enable signal for the passenger conveying system. Operation of the safety circuit to stop operation of the passenger conveying system is discussed in more detail below.

A redundant interrupt switch may be provided. The redundant interrupt switch may be arranged in series with the interrupt switches to conduct the drive enable signal. The redundant interrupt switch should be independent from the switches S1-SN, that is, the redundant interrupt switch should not be controlled by switches S1-SN. The redundant interrupt switch may be used to interrupt the drive enable signal if there is a failure in opening any of interrupt switches. The redundant interrupt switch may comprise electrical switches, electro-mechanical switches, and/or mechanical switches.

For example, the redundant interrupt switch may comprises a redundant relay including coil 25 and contacts 26. The redundant relay should be independent from the switches S1-SN, that is, the redundant relay should not be controlled by switches S1-SN. The redundant relay may have its contacts 26 arranged in series with contacts $\mathbf{20}_1$-$\mathbf{20}_N$ to conduct the drive enable signal. Current flow through the coil 25 may be controlled by a controller, such as microprocessor 34. The redundant relay may be used to interrupt the drive enable signal if there is a failure in opening any of contacts $\mathbf{20}_1$-$\mathbf{20}_N$.

When the switches S1-SN close and open, the switch output signals take a first state and a second state corresponding to a logic level high and logic level low, respectively. The logic level high and logic level low is present at the inputs A1-AN. Microprocessor 34 may monitor the logic levels at the inputs A1-AN and an output SAFE_OUT of the series arrangement of contacts. Sense circuits $SE_1$-$SE_N$ may detect the logic high or logic low at inputs A1-AN. A separate sense circuit $SE_1$-$SE_N$ should be provided for each switch S1-SN. The sense circuits $SE_1$-$SE_N$ may be coupled to microprocessor 34 for monitoring the logic level at inputs A1-AN. A sense circuit 50 may also be coupled to the output SAFE_OUT. The microprocessor 34 may monitor SAFE_OUT via the sense circuit 50. The microprocessor 34 may send a signal to open one or more of the contacts $\mathbf{20}_1$-$\mathbf{20}_N$ and/or 26 based on the logic levels at the inputs A1-AN and SAFE_OUT.

In operation of the safety circuit, a respective switch S1-SN is opened when a fault in the passenger conveying system is detected. In the embodiment shown, opening a switch S1-SN interrupts current flow through that switch S1-SN and causes a logic low at the corresponding input A1-AN. A logic low at any one of inputs A1-AN should cause interruption of the drive enable signal. Interruption of the drive enable signal may be done in several ways. The opening of any one of the switches S1-SN interrupts current flow through the corresponding coil $\mathbf{14}_1$-$\mathbf{14}_N$, causing the corresponding contact $\mathbf{20}_1$-$\mathbf{20}_N$ to open. Opening any one of the contacts $\mathbf{20}_1$-$\mathbf{20}_N$ interrupts the drive enable signal to stop operation of the passenger conveying system. Opening any one of the contacts $\mathbf{20}_1$-$\mathbf{20}_N$ also causes a logic low at SAFE_OUT.

The logic level at the inputs A1-AN is detected and compared with the logic level at the output SAFE_OUT by the microprocessor 34 to ensure proper operation of the safety circuit. If a logic low is detected at any one of the inputs A1-AN, but a logic high is present at SAFE_OUT, an error has occurred. For example, the contacts of a relay may be welded shut, maintaining the logic high at SAFE_OUT.

In such a case, microprocessor 34 may send a signal to stop operation of the passenger conveying system device. For example, the microprocessor 34 may send a signal to open redundant relay contacts 26 via coil 25. If the signal to the redundant relay does not interrupt the drive enable signal, the microprocessor 34 may send a signal to open additional ones or all of the relay contacts $\mathbf{20}_1$-$\mathbf{20}_N$. The microprocessor 34 may also generate fault codes to indicate where an error occurred, for example, which contacts failed to open.

Figure 2:
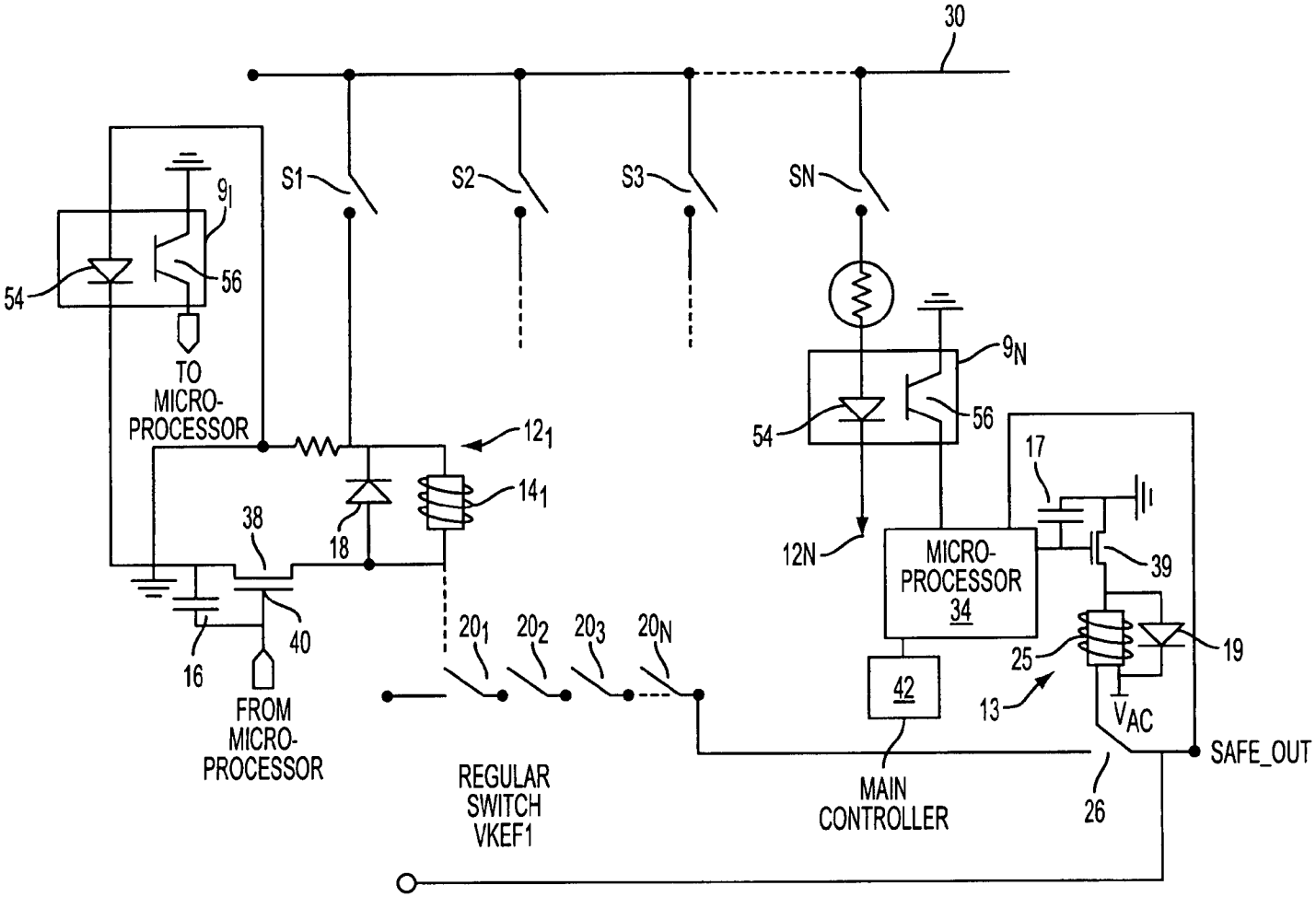
FIG. 2 is a schematic diagram of a circuit according to an exemplary embodiment of the invention.

FIG. 2 illustrates a more detailed example of the safety circuit. In the embodiment illustrated in FIG. 2, the sense circuits $SE_1$-$SE_N$ comprise opto-isolators $\mathbf{9}_1$-$\mathbf{9}_N$. Each opto-isolator includes a light emitting diode 54 and a photo-transistor 56. Each switch S1-SN is coupled to a respective relay $\mathbf{12}_1$-$\mathbf{12}_N$ and to an opto-isolator 9, although only the relay 12 associated with switch S1 on the left side of the drawing is illustrated. An opto-isolator 9 should be associated with each switch S1-SN. An output of each opto-isolator $\mathbf{9}_1$-$\mathbf{9}_N$ is provided to the microprocessor 34. Based on the information received from the opto-isolator 9, the microprocessor 34 can determine whether a switch S1-SN is open or closed.

Referring to relays $\mathbf{12}_1$-$\mathbf{12}_N$, diode 18 may be coupled to the coils $\mathbf{14}_1$-$\mathbf{14}_N$ and contacts $\mathbf{20}_1$ $\mathbf{20}_N$. In addition, each coil $\mathbf{14}_1$-$\mathbf{14}_N$ may be respectively connected in series with a transistor 38 to control the flow of current through the coil. The transistors 38 may be controlled by a signal from the microprocessor 34. For example, a control electrode 40 of the transistors 38 may receive a control signal from the microprocessor 34. The microprocessor 34 provides the control signal to the control electrode 40 to turn on or turn off the transistor 38, allowing or disabling current flow through the respective relay coil $\mathbf{14}_1$-$\mathbf{14}_N$. A capacitor 16 may also be provided as will be understood by those skilled in the art.

Redundant relay 13 may include diode 19 coupled to the coil 25 and contacts 26. In addition, coil 25 may be connected in series with a transistor 39 to control the flow of current through the coil 25. The transistor 39 may be controlled by a signal from the microprocessor 34. For example, microprocessor 34 provides the control signal to turn on or turn off the transistor 39, allowing or disabling current flow through the coil 26. Capacitor 17 may also be provided The microprocessor 34 on the controller board 32 may be in communication with a main controller 42. The main controller 42 controls the operation of the passenger conveying system.

A method of operating an exemplary embodiment of a safety circuit, such as the safety circuit described above is now described. When a switch S1-SN opens, for example due to a fault in a corresponding functional unit, the corresponding coil $\mathbf{14}_1$-$\mathbf{14}_N$ de-energizes, causing corresponding contacts $\mathbf{20}_1$-$\mathbf{20}_N$ to open. The drive enable signal is interrupted and the output SAFE_OUT should be a logic low. At the same time, a logic low is present at the corresponding input A1-AN on the controller board 32. The microprocessor 34 monitors the output SAFE_OUT and the output of the switches S1-SN at inputs A1-AN. When operating properly, SAFE_OUT is a logic low when any one of the inputs A1-AN is a logic low. If this is not the case, an error is detected.

For example, if the microprocessor 34 detects that the logic level at input A1 is low, but the output SAFE_OUT is high, an error is detected. This may occur, for example, if the relay contacts $\mathbf{20}_1$ become welded shut. An error code for coil $\mathbf{14}_1$ and contacts $\mathbf{20}_1$ may the be generated. When such an error is detected, the microprocessor 34 may send a signal to open redundant relay contacts 26. This may be done by causing transistor 39 to turn off, interrupting current flow through the redundant relay coil 25, which, in turn, opens relay contacts 26, interrupting the drive enable signal and causing the passenger conveying system to stop.

It is possible that an error may occur in opening relay contacts 26. Therefore, the microprocessor 34 may continue to monitor the output SAFE_OUT after sending the signal to open redundant relay contacts 26. If the redundant relay contacts 26 fail to interrupt the drive enable signal and to cause the output SAFE_OUT to go low, the microprocessor 34 detects the error. The microprocessor 34 may then send a signal to open one or more of relays contacts $\mathbf{20}_1$-$\mathbf{20}_N$ to interrupt the drive enable signal, for example via transistors 38, thereby providing another level of redundancy.

It is further possible that an error may occur with the microprocessor 34. The main controller 42 may monitor the microprocessor 34 to ensure that the microprocessor 34 is operational. For example, messages may be intermittently exchanged between the microprocessor 34 and main controller 42. If the main controller 42 does not receive an expected message from the microprocessor 34 and/or an expected acknowledgement, the main controller 42 may determine that the microprocessor 34 is not operational. In such a case, the main controller 42 may send a signal to de-energize the motor and brake contactors of the passenger conveying system.

Additionally, after a fault with the passenger conveying system is detected and a switch S1-SN opened, the safety circuit is set to a "not ready" mode. In order to change to a "ready" mode, the main controller 42 requires a test of the safety circuit. Each of the switches S1-SN and relays should be tested before a change to the "ready" mode is allowed. During the test, the microprocessor 34 may send a signal to open each relay contact $\mathbf{20}_1$-$\mathbf{20}_N$ and 26 to check if the output SAFE_OUT is a logic low when the signal to open that particular relay is sent. If the output SAFE_OUT does not go low, an error is detected for that relay. For any errors, a fault report indicating the relay(s) which had the error may be generated.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

What is claimed is:

1. A safety circuit for a passenger conveyor having a drive system, comprising:

a plurality of controllable switches, each switch of the first plurality of controllable switches being responsive to a functional unit associated with the passenger conveyor to produce a first switch output signal having a first state if the functional unit is operating properly and a second state if the functional unit is malfunctioning;

a controller apparatus including:

a plurality of input terminals each coupled to a respective one of the switches for receiving the respective switch output signals;

a plurality of interrupt switches, each interrupt switch being arranged in electrical series to conduct a drive enabling signal for the drive system when all of the interrupt switches are in a closed state, each interrupt switch being coupled to a respective one of the input terminals and being opened in response to a respective first switch output signal having the second state to interrupt the drive enabling signal to stop operation of the drive system;

a redundant interrupt switch arranged in electrical series with the plurality of interrupt switches, wherein the series connection of the redundant interrupt switch and the plurality of interrupt switches has an output producing a second out signal having a first state if all of the interrupt switches and the redundant interrupt switch are closed and a second a state if any one of the interrupt switches and the redundant interrupt switch is open; and a controller arranged to monitor the state of the first switch output signals of the plurality of controllable switches and to monitor the state of the second output signal, the controller sending a signal to open the redundant interrupt switch when the signal state of the any one of the first switch output signals has the second output state and the second output signal has the first signal state.

2. The circuit of claim 1, wherein the controller is operative to send a signal to open all interrupt switches when the signal state of the any one of the switch output signals has the second output state and the output of the series connection of the interrupt switches and the redundant interrupt switch has the first signal state after sending the signal to open the redundant interrupt switch.

3. The circuit of claim 1, further comprising a main controller monitoring operation of the controller, the main controller sending a shutdown signal to the drive system when the controller malfunctions.

4. The circuit of claim 1, further comprising individual wires each connecting a respective one of the plurality of controllable switches to the corresponding input terminals.

5. The circuit of claim 1, wherein the interrupt switches comprise respective relays, each relay including a coil and contacts.

6. The circuit of claim 5, further comprising electronic switches each arranged in series with a respective one of the relays, each electronic switch receiving a control signal from the controller to open or close, disabling or enabling, respectively, current flow through the respective relay.

7. The circuit of claim 1, wherein the redundant relay is controlled solely by the controller.

8. The circuit of claim 1, further comprising a plurality of sensing circuits each coupled between a respective one of the input terminals and the controller to monitor the state of the switch output signal.

9. The circuit of claim 7, wherein each sensing circuit comprises an opto-coupler.

10. The circuit of claim 1, wherein the controllable switches are connected in electrical parallel.

11. A method of disabling a drive system of a passenger conveying system, comprising:

monitoring the passenger conveying system with switches each arranged to detect a respective malfunction of the passenger conveying system;

providing a shutdown signal from a respective one of the switches detecting the respective malfunction to a corresponding shutdown contact and to a controller;

operating the corresponding shutdown contact to interrupt a drive enabling signal of the drive system in response to receipt of the shutdown signal from one of the switches;

monitoring the shutdown signals from the switches and the drive enabling signal with the controller;

sending a signal from the controller to open a redundant contact to interrupt the drive enabling signal if the shutdown signal is detected and the drive system remains enabled.

12. The method of claim 11, further comprising:

monitoring the drive enable signal with the controller after sending the signal from the controller to open the redundant contact; and sending a signal from the controller to open at least one of the other shutdown contacts if the drive system remains enabled after sending the signal to the redundant contact.

13. The method of claim 11, wherein the passenger conveying system includes a plurality of relays each coupled to a respective one of the switches, each relay including a coil and corresponding shutdown contacts, the method further comprising:

opening one of the switches when a respective malfunction is detected to interrupt current flow through the coil of the relay associated with the opened switch and causing the corresponding shutdown contacts of the relay to open; and detecting an open switch with the controller.

14. The method of claim 13, further comprising:

monitoring operation of the controller with a main controller; and sending a signal from the main controller to disable the drive system when the controller malfunctions.

15. A method, comprising:

monitoring a passenger conveying system with functional units, each functional unit having a switch;

providing a shutdown signal from a respective switch for the functional unit to a controller and to a corresponding shutdown contact when a fault with the passenger conveying system is detected by the functional unit;

detecting with the controller if the shutdown contact opens;

sending a signal from the controller to open a redundant contact if the shutdown contact does not open.

16. The method of claim 15, further comprising:

monitoring with the controller if the redundant contact opens; and sending a signal from the controller to open at least one of the other shutdown contacts if the redundant contact does not open.

17. The method of claim 15, further comprising:

providing the controller and the shutdown contacts on a controller board; and coupling each switch to the controller board via a single wire.

18. The method of claim 15, further comprising:

performing a self-test after a fault with the passenger conveying system is detected; and restarting the passenger conveying system only if the test is passed.

19. The method of claim 18, wherein the self-test comprises:

sending a signal to each of the shutdown contacts to open;

detecting if the respective shutdown contacts open; and generating an error if the respective shutdown contact does not open when it receives the signal.

20. A safety circuit for a passenger conveyor having a drive system, comprising:

a plurality of switches connected in electrical parallel, each switch being responsive to a functional unit associated with the passenger conveyor to produce a switch output signal having a first state if the functional unit is operating properly and a second state if the functional unit is malfunctioning;

a controller apparatus including:

a plurality of input terminals each coupled to a respective one of the switches by a respective individual wire for receiving the respective switch output signals; and a plurality of sets of contacts arranged is electrical series to conduct a drive enabling signal for the drive system when the contacts are all in a closed state, each set of contacts being opened in response to a respective switch output signal having the second state to interrupt the drive enabling signal to stop operation of the drive system.

21. The circuit of claim 20, wherein the controller apparatus further comprises:

a redundant relay having contacts arranged in electrical series with the set of contacts, wherein the series connection of the contacts has an output producing a signal having a first state if all of the contacts are closed and a second a state if any one of the contacts is open; and a controller arranged to monitor the state of the switch output signals and to monitor the state of the output signal of the contacts of the relays, the controller sending a signal to open the redundant relay when the signal state of the any one of the switch output signals has the second output state and the output of the series connection of contacts has the first signal state.

* * * * *